US006954186B2

(12) United States Patent
Ide et al.

(10) Patent No.: US 6,954,186 B2
(45) Date of Patent: Oct. 11, 2005

(54) PLASMA DISPLAY PANEL UNIT

(75) Inventors: Shigeo Ide, Yanamashi-ken (JP); Toshiaki Kani, Fukuroi (JP)

(73) Assignees: Pioneer Corporation, Tokyo-to (JP); Pioneer Display Products Corporation, Shizuoka-ken (JP)

( * ) Notice: Subject to any disclaimer, the term of this patent is extended or adjusted under 35 U.S.C. 154(b) by 182 days.

(21) Appl. No.: 10/174,957

(22) Filed: Jun. 20, 2002

(65) Prior Publication Data

US 2003/0001802 A1 Jan. 2, 2003

(30) Foreign Application Priority Data

Jun. 29, 2001 (JP) ..... P2001-197990

(51) Int. Cl.[7] ..... G09G 3/28
(52) U.S. Cl. ..... 345/60; 345/68
(58) Field of Search ..... 345/60, 62, 63, 345/65, 68, 55, 66, 596, 77, 147, 211, 212, 167, 169.1, 169.4; 313/582, 584, 586, 574; 315/169.1, 169.4

(56) References Cited

U.S. PATENT DOCUMENTS 4,594,588 A 6/1986 Barclay et al.
5,633,659 A * 5/1997 Furuhashi et al. ..... 345/173
5,757,343 A 5/1998 Nagakubo
5,956,014 A * 9/1999 Kuriyama et al. ..... 345/690
6,229,724 B1 * 5/2001 Virtanen ..... 363/89
6,388,678 B1 * 5/2002 Kasahara et al. ..... 345/690
6,580,406 B2 * 6/2003 Watanabe ..... 345/63
6,650,307 B1 * 11/2003 Toda et al. ..... 345/63

FOREIGN PATENT DOCUMENTS

EP 1047040 A1 10/2000
JP 08101661 A * 4/1996
JP 9-6283 1/1997
WO WO 0009607173 A1 * 3/1996

* cited by examiner

*Primary Examiner*—Vijay Shankar
*Assistant Examiner*—Nitin Patel
(74) *Attorney, Agent, or Firm*—Sughrue Mion, PLLC

(57) ABSTRACT

The plasma display panel (PDP) unit of the present invention comprises a PDP drive circuit for supplying drive power to a display panel and a control portion for controlling the drive power. The control portion includes a power correction value generating circuit for generating a power correction value and the PDP drive circuit contains a voltage adjusting circuit for outputting the drive power based on the power correction value.

21 Claims, 6 Drawing Sheets

PLASMA DISPLAY PANEL UNIT

BACKGROUND OF THE INVENTION

1. Field of the Invention

The present invention relates to technology relating to matrix type plasma display panel (PDP) and more particularly to technology relating to plasma display panel whose drive power supply is automatically adjusted.

2. Description of the Related Art

Conventionally, the drive voltage for a sustain driver and a scan driver has been adjusted by adjusting variable resistance upon shipment so as to secure an amount of margin corresponding to an influence upon the PDP by a change in temperature upon operation, a change of the PDP itself by time passage and the like. More specifically, a voltage adjusting circuit shown in FIG. 6 is inserted during a supply of electric power to the aforementioned driver and the variable resistor R63 is adjusted so as to correct the voltage of an input to an amplifier 60 thereby adjusting the driving voltage.

Conventional technology about the driving circuit of the PDP unit has been disclosed in Japanese Patent Application Laid-Open No. 2000-293135.

However, it takes skill for adjustment of this PDP and therefore there is a limit in reduction of adjustment cost. Further, there is a room in which human error may be induced.

The intensity of illumination is changed by a change in temperature at the time of startup and after long-hour use and this intensity of illumination is changed by a change with time passage of the PDP itself also. However, the change in the intensity of illumination in the PDP cannot be eliminated completely by adjustment of a single time before shipment.

In the above-mentioned Japanese Patent Application Laid-Open No. 2000-293135, the power supply is described only a symbol of the DC power supply in FIG. 3, is not described about a voltage adjusting function.

SUMMARY OF THE INVENTION

An object of the present invention is to provide a PDP unit capable of eliminating human error upon adjustment of the PDP drive power and reducing cost.

The above object of the present invention can be achieved by a plasma display panel unit provided with: a panel driving device which supplies drive power to a display panel and a power control device which controls the drive power, wherein the power control device has a power correction value generating device which generates power correction value; and the panel driving device has a drive power changing device which changes and outputs the drive power based on the power correction value.

As a result, the drive power is changed based on the power correction value and outputted to the driver. Therefore, the drive power of the driver can be adjusted.

According to the present invention, automatic adjustment of the drive voltage is enabled. Thus, it is possible to omit voltage adjustment by skilled persons to eliminate human error completely and reduce cost.

The above object of the present invention can be achieved by a plasma display panel unit provided with a panel driving device which supplies drive power to a display panel and a voltage control device which control the voltage of the drive power, wherein the voltage control device has a voltage correction value generating device which generates voltage correction value; and the panel driving device has a drive voltage changing device which changes and outputs the drive voltage based on the voltage correction value.

Because the drive voltage is changed based on the voltage correction value and outputted to the driver, the drive voltage of the driver can be adjusted.

In one aspect of the plasma display panel unit of the present invention, the plasma display panel unit is further provided with at least any one of a temperature detecting device which detects the temperature of the display panel and a usage time computing device which computes usage time of the display panel, wherein the voltage correction value generating device generates the voltage correction value based on at least any one of a detected panel temperature and a measured usage time.

Because the control portion outputs the voltage correction value considering usage time or temperature of the panel, the drive voltage can be automatically adjusted corresponding to an influence by a change in the PDP temperature upon operation, changes in the PDP itself with time passage and the like.

Because the control portion can automatically output the voltage correction value and adjust the drive voltage considering panel usage time and panel temperature, it is possible to eliminate an influence by the temperature change in the PDP, an influence by the PDP itself with time passage and the like.

In another aspect of the plasma display panel unit of the present invention, the plasma display panel unit is further provided with an external control signal receiving device which receives an external control signal from outside, wherein the voltage correction value generating device generates the voltage correction value based on the external control signal.

Consequently, the control portion can receive the control signal from the remote controller, personal computer and the like and output the voltage correction value so as to adjust the drive voltage.

DESCRIPTION OF THE PREFERRED EMBODIMENTS

Hereinafter, an embodiment of a plasma display panel (PDP) unit of the present invention will be described with reference to the accompanied drawings.

Figure 1:
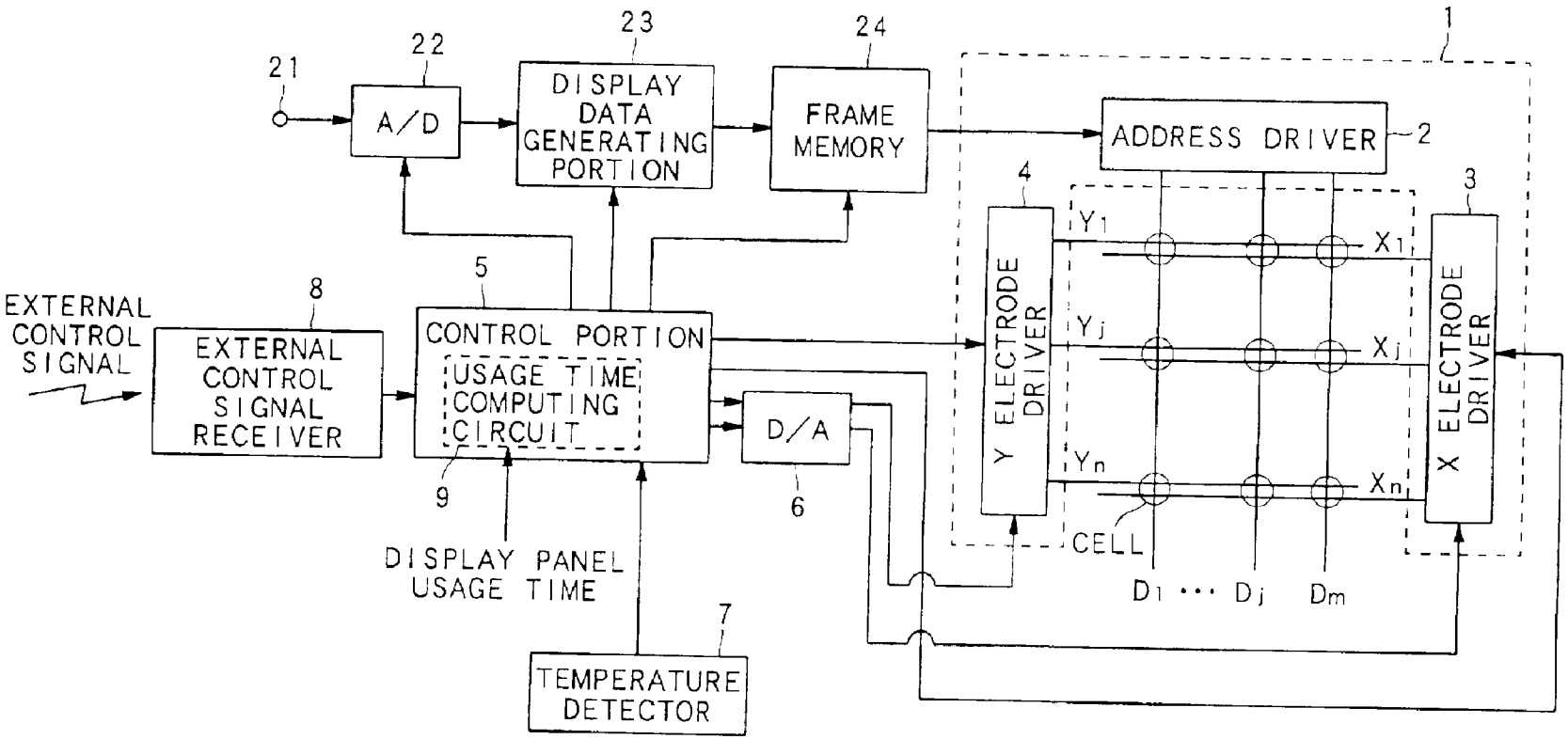
FIG. 1 is a block diagram showing an outline of the PDP unit according to an embodiment of the present invention.

FIG. 1 is a block diagram showing an outline of the PDP unit.

The PDP unit comprises an input terminal 21, an A/D converter 22, a display data generating portion 23, a frame memory 24, a control portion 5, and a D/A converter 6. A PDP drive circuit acting as a panel driving device includes an address driver 2, an X electrode driver 3, and a Y electrode driver 4. Further, a PDP display unit includes a temperature detector 7 which works as a temperature detecting device for the display panel, a usage time counting circuit 9 which works as a usage time counting device for the display panel, and an external control signal receiver 8 which works as an external control signal receiving device.

A video signal inputted from the input terminal 21 is converted to digital video data by the A/D converter 22, processed to display data by the display data generating portion 23, and then supplied to the frame memory 24. The display data generating portion 23 computes emission time corresponding to the intensity of illumination of video data and corrects the data by reallocation so as to generate display data. The frame memory 24 is composed of, for example, a VRAM, which accumulates display data of a screen sent from the display data generating portion 23 and supplies it to the address driver 2 following synchronous signal from a control portion 5 which will be described later. The address driver 2 is composed of a driving circuit having a DC power supply and switching device, and generates pixel data pulse to each discharge cell on the display panel based on the display data inputted from a frame memory 24 and applies this to a column electrode Dj for every display line.

Figure 3:
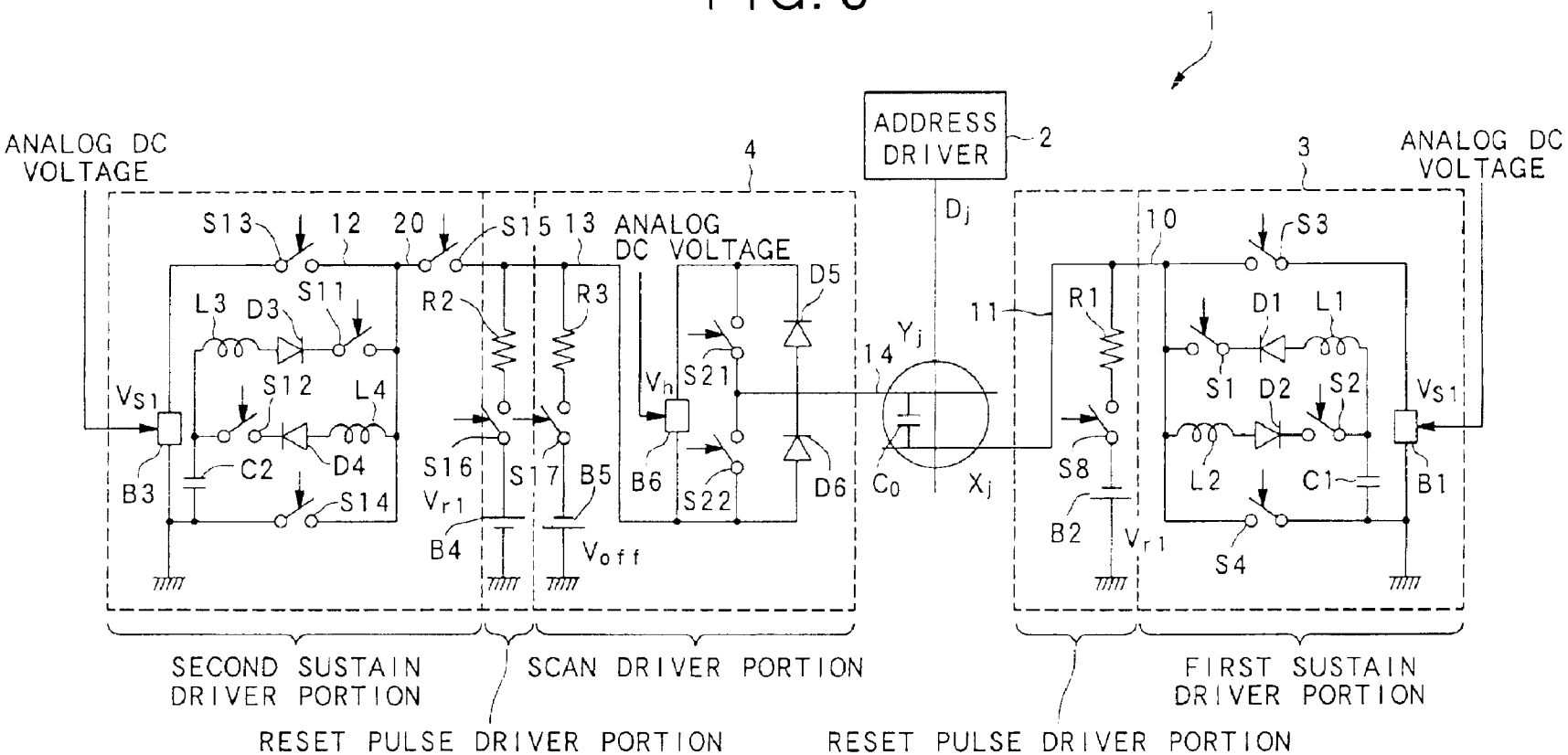
FIG. 3 is a conceptual diagram showing the structure of the PDP drive circuit according to an embodiment of the present invention.

The control portion 5 is composed of, for example, CPU, which outputs synchronous signal to the A/D converter 22, the display data generating portion 23 and the frame memory 24. Further, the control portion 5, which works as a voltage control device, includes a voltage correction value generating circuit, which works as a voltage correction value generating device, so as to output a voltage correction value to adjust the PDP driving voltage. The D/A converter 6 converts the voltage correction value that the control portion 5 outputs in the form of digital value into an voltage correction value which is an analog signal and outputs it to an X-electrode driver 3 and a Y-electrode driver 4. As shown in FIG. 3, each of the X-electrode driver 3 and the Y-electrode driver 4 is constituted of a driving circuit containing a DC power supply and switching devices. Based on synchronous signal from the control portion 5, the X-electrode driver 3 applies sustain discharge pulse IPx to the electrode Xj and the Y-electrode driver 4 applies sustain discharge pulse IPy to the electrode Yj.

The temperature detector 7 of the display panel detects the temperature of a display panel and outputs the result of detection to the control portion 5. The usage time computing circuit 9 of the display panel computes a time in which the power of the display panel is turned ON and is part of the control portion 5. The external control signal receiver 8 receives a control signal from outside, for example, a remote controller or personal computer and outputs its content to the control portion 5.

The operation of the PDP unit having such a structure will be described below.

A video signal inputted from the input terminal 21 as an analog signal is converted to digital video data by the A/D converter 22, processed to display data by the display data generating portion 23, and supplied to the frame memory 24. The frame memory 24 accumulates display data sent from the display data generating portion 23 and supplies it to the address driver 2 following synchronous signal from the control portion 5.

A synchronous signal is separated from the video signal inputted from the input terminal 21 by a sync separation circuit (not shown), and then the control portion 5 outputs the synchronous signal to the A/D converter 22, the display data generating portion 23 and the frame memory 24 on the basis of this separated synchronous signal. The control portion 5 drives the PDP by controlling ON/OFF of a switching device of the PDP driving circuit 1, which is a panel driving device shown in FIG. 3. Additionally, the control portion 5 outputs an appropriate voltage correction value by computing a drive voltage of the PDP according to the result of temperature detection on the display panel and usage time of the display panel. Further, the control portion 5 receives a control signal from outside, for example, a remote controller or a personal computer, and computes a voltage correction value depending upon its content, and outputs. At this time, the D/A converter 6 converts the voltage correction value to be outputted by the control portion 5 as digital value to analog value and outputs the result to the X electrode driver 3 or the Y electrode driver 4. Therefore, the control portion 5 facilitates adjustment of the driver voltage by means of a voltage adjusting circuit, which will be described later.

The drive sequence of the PDP unit will be described with reference to FIG. 2.

Figure 2:
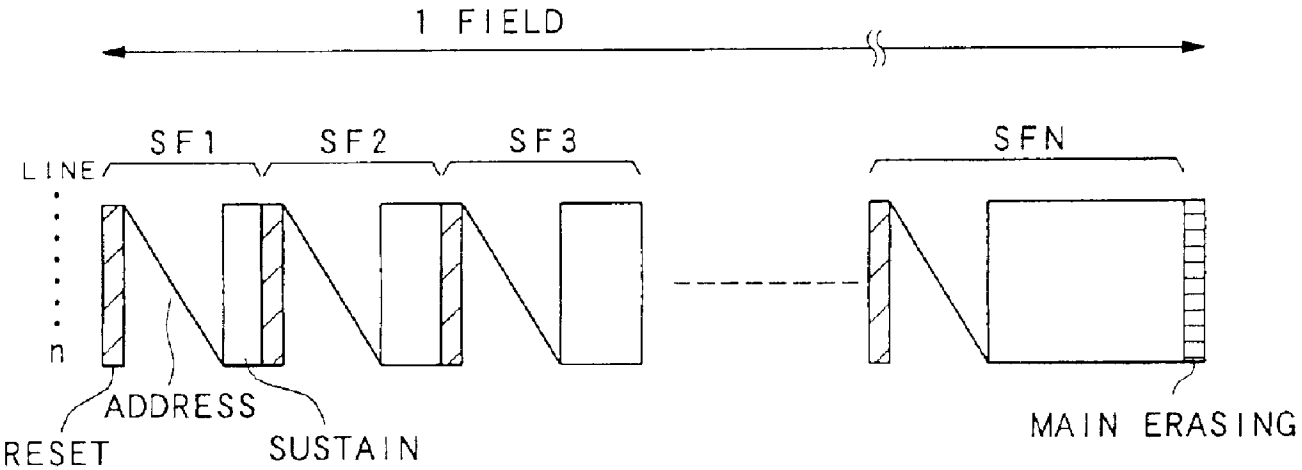
FIG. 2 is a schematic diagram showing the drive sequence of the PDP according to an embodiment of the present invention.

FIG. 2 is a schematic diagram showing the drive sequence of the PDP according to an embodiment of the present invention.

A set of a sub-field (1 SF) has a reset period, an address period, and a sustain period. A set of a field, which is a drive sequence of the PDP, has several sub-fields, repeated N times, and thereafter a main erase process for resetting to a condition in which wall charge is erased by applying erase pulse respectively to all cells.

In the reset period, all the discharge cells of the PDP unit are gotten into luminous discharge cell condition. In the subsequent address period, the address driver 2 forms wall charge selectively to each discharge cell based on video signal so as to generate pixel data pulse which sets up luminous discharge cell or non-luminous discharge cell and apply this pulse to a column electrode of every display line. In the sustain period, sustain discharge pulse $IP_x$ and sustain discharge pulse $IP_y$ are generated alternately and applied to the column electrode X and column electrode Y alternately. As a result, in a luminous discharge cell in which the above-described wall charge remains, discharge light emission is repeated and then that light emission is sustained.

The PDP unit of this embodiment adjusts the voltage of the X electrode driver 3 or the Y electrode driver 4 in the address period and the sustain period.

FIG. 3 is a conceptual diagram showing the structure of the PDP drive circuit 1 of this embodiment.

The PDP drive circuit 1, which works as a panel drive device, is comprised of the address driver 2, the X electrode driver 3, and the Y electrode driver 4. The X electrode driver 3 includes a reset pulse driver portion and a first sustain driver portion. The Y electrode driver 4 includes a reset pulse driver portion, a scan driver portion, and a second sustain driver portion.

The reset pulse driver portion applies a reset pulse respectively to all the column electrodes $X_1$–$X_n$, $Y_1$–$Y_n$ at the same time in the reset period. Consequently, all the discharge cells in the PDP unit are simultaneously discharged and excited to generate charged particles. After this discharge is stopped, a predetermined quantity of wall charges are accumulated on a dielectric layer of the discharge cells, so that luminous discharge cell condition is attained.

The scan driver portion applies a scan pulse SP to the electrode $Y_j$ in the address period so as to set the electrode $Y_j$ to a predetermined positive potential ($V_h$–$V_{off}$). This application is carried out synchronously with application of pixel data pulse $DP_j$ from the address driver 2. As a result, of the cells of the column electrode on which the scan pulse SP is applied, discharge occurs in only a cell onto which pixel data pulse of positive voltage is applied at the same time.

The first sustain driver portion and the second sustain driver portion generate sustain discharge pulse $IP_x$ and sustain discharge pulse $IP_y$ alternately in the sustain period and apply it to the column electrodes $X_1$–$X_n$ and the column electrodes $Y_1$–$Y_n$ alternately. Consequently, discharge light emission is repeated in the light emission discharge cell in which the wall charge remains, and the light emission is sustained.

The operation of the PDP drive circuit 1 having the above described structure will be described below.

The column electrode $X_j$ is an electrode at the column j (one electrode composing the j display line) in the column electrodes $X_1$–$X_n$ and the column electrode $Y_j$ is an electrode at the column j (the other electrode composing the j display line) in the column electrodes $Y_1$–$Y_n$. The display panel cell is located between the column electrode $X_j$ and $Y_j$ which form a pair and acts as a capacitor $C_o$. A power supply B1 outputs sustain voltage $V_{s1}$ and the voltage changes depending on an input of the voltage correction value from the control portion 5. A power supply B2 outputs a reset voltage $V_{r1}$.

The power supply B3 outputs the sustain voltage $V_{s1}$ and the voltage changes depending on input of the voltage correction value from the control portion 5. The power supply B4 outputs the reset voltage $V_{r1}$. The power supply B5 generates the voltage $V_{off}$ and the power supply B6 generates the scan pulse voltage $V_h$ including the analog voltage correction value.

Because the voltage correction value can be inputted to the power supplies B1, B3, the sustain voltage can be adjusted and because the voltage correction value can be inputted to the power supply B6, the scan pulse voltage can be adjusted.

A voltage adjusting circuit for use in the sustain driver power supplies B1, B3 and the scan driver power supply B6 in the PDP drive circuit 1 having such a structure will be described below.

Figure 4:
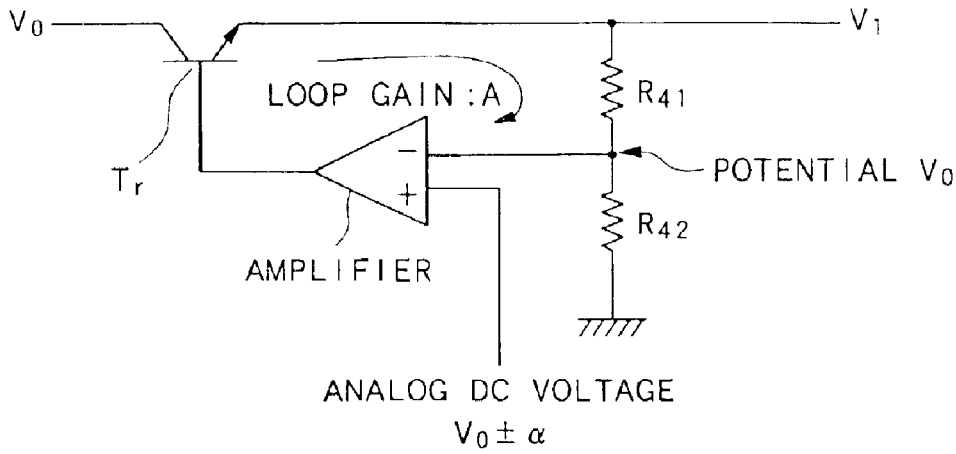
FIG. 4 is an outline diagram of a voltage adjusting circuit according to an embodiment of the present invention.

FIG. 4 is an outline diagram of the voltage adjusting circuit of this embodiment.

The voltage adjusting circuit of this embodiment is a drive voltage changing device and includes a loop circuit comprised of an amplifier, a transistor Tr and resistor $R_{41}$ as shown in FIG. 4. Hereinafter, a loop gain is as A for describing.

Hereinafter, the operation of the voltage adjusting circuit having the above-described structure will be described.

If analog voltage $V_0 \pm \alpha$ containing $\pm\alpha$ analog voltage correction value in its original input voltage $V_0$ is inputted into the voltage adjusting circuit shown in FIG. 4 from the control portion, an increase/decrease amount $\Delta V_1 = \pm A \cdot \alpha$ is added to the original output voltage $V_1$ because the loop gain is A, so that the output voltage $V_1 \pm \Delta V_1$ is applied to the driver. Thus, the voltage correction value $\pm\Delta V_1$ acts on the driver so as to enable adjustment of the driver drive voltage.

The voltage adjusting circuit having such a structure is disposed at power supplies B1, B3, B6 of the PDP drive circuit 1 and the voltage correction value outputted from the control portion 5 is inputted as analog voltage correction value through the D/A converter 6. Thus, the sustain voltage can be adjusted at the power supplies B1 and B3. The scan pulse voltage can be adjusted at the power supply B6.

Figure 5:
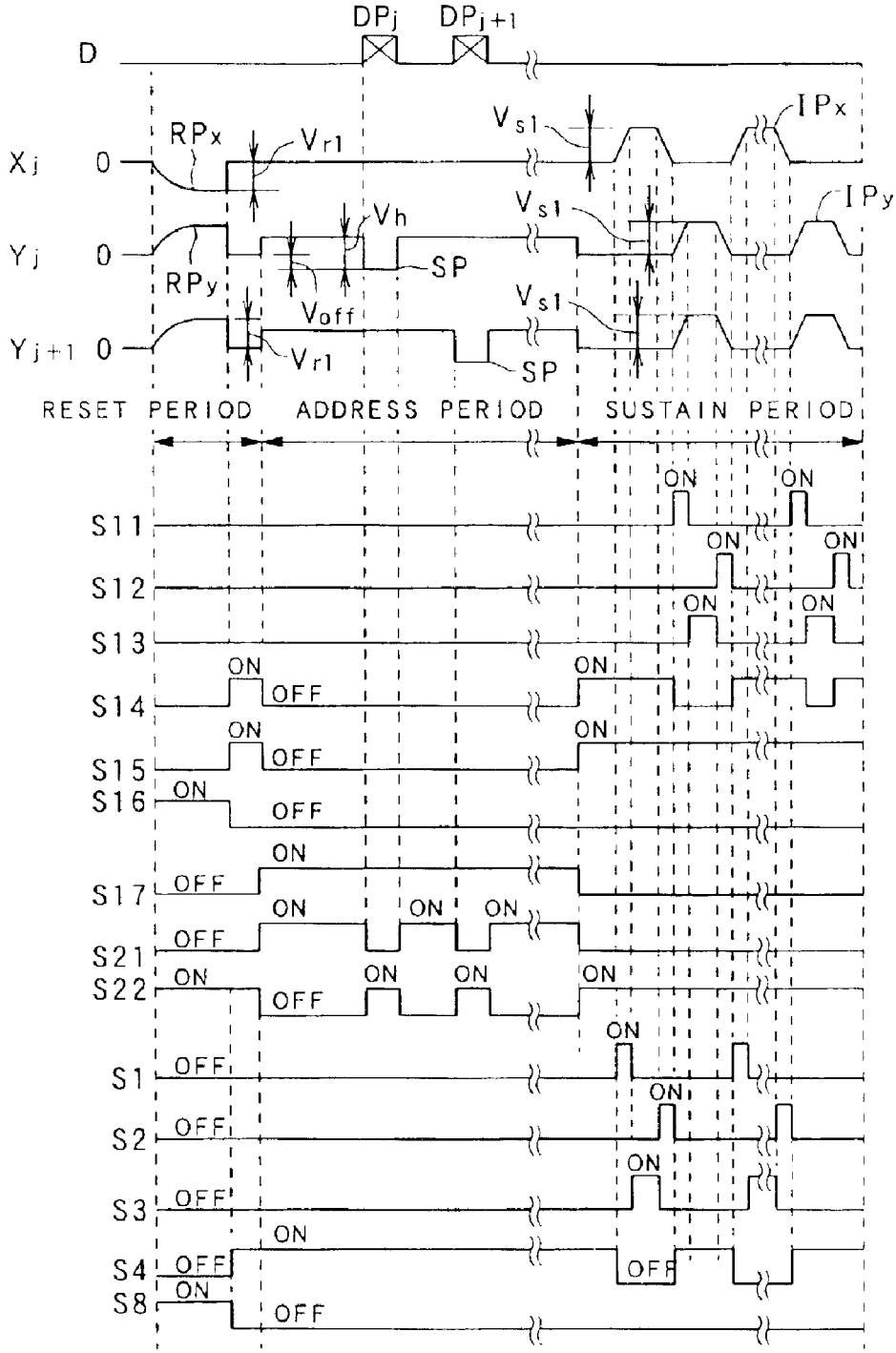
FIG. 5 is a conceptual diagram showing the drive sequence of the PDP according to an embodiment of the present invention.
Figure 6:
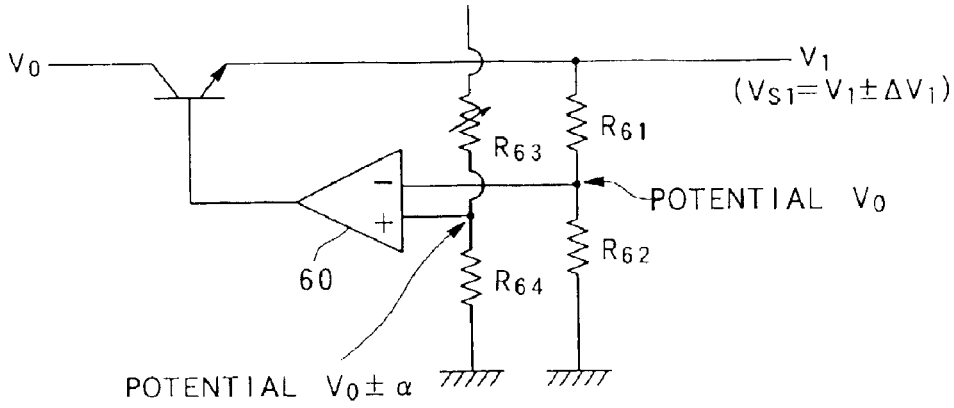
FIG. 6 is a circuit diagram showing a conventional voltage adjusting circuit.

The operation of the PDP drive circuit 1 having such a structure will be described with reference to a time chart shown in FIG. 5. The drive sequence of this PDP describes the operation in a single sub-field. Subsequently, the reset period, address period, and sustain period will be described separately.

First, in the reset period, a switching device S8 of the X electrode driver 3 is turned ON, and at the same time, switching devices S16 and S22 of the Y electrode driver 4 are turned ON. The other switching devices are kept OFF. When the switching device S8 is turned ON, current flows from the electrode $X_j$ to a negative terminal of the power supply B2 through a resistor R1 and a switching device S8. When the switching device S16 is turned ON, current flows into the electrode $Y_j$ from a positive terminal of a power supply B4 through a switching device S16, a resistor R1, and a switching device S22. The potential of the electrode $X_j$ is decreased gradually depending upon time constant of a capacitor $C_o$ and the resistor R1 so that a reset pulse $RP_X$ is generated. The potential of the electrode $Y_j$ is increased gradually depending on time constant of the capacitor $C_o$ and the resistor R1 so that a reset pulse $RP_y$ is generated. Then, the potential of the reset pulse $RP_x$ is saturated to the voltage level $-V_{r1}$ and the potential of the reset pulse $RP_y$ is saturated to the voltage level $V_{r1}$. This reset pulse $RP_x$ is applied to all the column electrodes $X_1$–$X_n$ at the same time and the reset pulse $RP_y$ is applied to all the column electrodes $Y_1$–$Y_n$ simultaneously.

When these reset pulses $RP_x$, $RP_y$ are applied at the same time, all discharge cells of the PDP are discharged and excited at the same time so as to generate charged particles. After this discharge is stopped, a predetermined quantity of wall charge is accumulated on dielectric layers of all discharge cells, so that luminous discharge cell condition is attained. When the reset pulses $RP_x$ and $RP_y$ are saturated after a predetermined time interval elapses, the switching device S8 and the switching device S16 are turned OFF before the reset period is terminated. At the same time, the switching devices S4, S14 and S15 are turned ON and the electrodes $X_j$, $Y_j$ are grounded. The reset period is terminated.

Next, in the address period, the address driver 2 forms wall charge selectively to each discharge cell based on display data outputted by the display data generating portion 23, pixel data pulses $DP_1$–$DP_m$ generate and the pulses set the cells the luminous discharge cells or non-luminous discharge cells. This process is applied to the column electrodes $D_1$–$D_m$ for every display line. Pixel data pulses $DP_j$, $DP_{j+1}$ are applied to the electrodes $Y_j$, $Y_{j+1}$. When the address period is started, the switching devices S14 and S15 are turned OFF, and the switching devices S17 and S21 are turned ON, and simultaneously the switching device S22 is turned OFF. If the switching devices S17 and S21 are turned ON, positive potential ($V_h$–$V_{off}$) is applied to the electrode $Y_j$. Because as described above, the power supply B6 generates scan pulse voltage $V_h$ containing analog voltage correction value, the positive potential ($V_h$–$V_{off}$), which is applied to the electrode $Y_j$ at this time, also contains voltage correction value.

The switching device S21 is turned OFF synchronously with application of the pixel data pulse $DP_j$ from the address driver 2 and then switching device S22 is turned ON. Consequently, a negative potential indicating the voltage $-V_{off}$ at a negative terminal of the power supply B5 is applied to as a scan pulse SP the electrode $Y_j$ through the switching device S22. Then, the switching device S21 is turned ON synchronously with termination of the pixel data pulse $DP_j$ from the address driver 2, and the switching device S22 is turned OFF, so that a predetermined positive potential $(V_h-V_{off})$ is applied to the electrode $Y_j$. After that, the scan pulse SP is applied to the electrode $Y_{j+1}$ also synchronously with application of the pixel data pulse $DP_{j+1}$ from the address driver 2 like the case of the electrode $Y_j$.

In the discharge cell belonging to the column electrode onto which the scan pulse SP is applied, discharge occurs only in a discharge cell onto which pixel data pulse of positive voltage is applied at the same time, so that wall charge of the cell erases. On the other hand, no discharge occurs in a discharge cell on which pixel data pulse of positive voltage is not applied at the same time although the scan pulse is applied and therefore, wall charge of the cell remains. In this case, the discharge cell in which the wall charge remains turns to a luminous discharge cell, while a discharge cell in which the wall charge is erased turns to a non-luminous discharge cell. When the address period is switched over to the sustain period, the switching devices S17 and S21 are turned OFF and at the same time, the switching devices S14, S15 and S22 are turned ON. The switching device S4 is kept ON.

Finally, the sustain period begins, the switching device S4 is turned OFF while the switching device S1 is turned ON. Consequently, current, whose origin is an electric charge accumulated in the capacitor C1, flows to the electrode $X_j$ through a coil L1, a diode D1, and the switching device S1 to charge the capacitor $C_o$. At this time, the potential of the electrode $X_j$ is raised gradually depending on time constant of the coil L1 and capacitor $C_o$. When half cycle of resonance cycle by the coil L1 and capacitor $C_o$ elapses, the switching device S1 is turned OFF while the switching device S3 is turned ON. Consequently, the potential of the electrode $X_j$ turns to an equal potential to the sustain voltage $V_{s1}$ containing the voltage correction value of the power supply B1.

After a predetermined time elapses, the switching device S3 is turned OFF while the switching device S2 is turned ON. As a result, current flows to the capacitor C1 through a coil L2, a diode D2 and the switching device S2 based on charge accumulated in the capacitor $C_o$ so as to charge the capacitor C1. At this time, the potential of the electrode $X_j$ lowers gradually depending on time constant of the coil L2 and capacitor $C_o$ When half cycle of resonance cycle by the coil L2 and capacitor $C_o$ elapses (when the potential of the electrode $X_j$ reaches 0V), the switching device S2 is turned OFF while the switching device S4 is turned ON.

By such operation, the X electrode driver 3 applies sustain discharge pulse $IP_x$ to the electrode $X_j$. At the same time when the switching device S4 for erasing the sustain discharge pulse $IP_x$ is turned ON, the Y electrode driver 4 turns ON the switching device S11 and turns OFF the switching device S14. When the switching device S14 is turned ON, the potential of the electrode $Y_j$ is at grounding potential of 0V. When the switching device S11 is turned ON while the switching device S14 is turned OFF, current flows to the electrode $Y_j$ through a coil L3, a diode D3, the switching device S11, a switching device S15 and a diode D6 based on electric charge accumulated on the capacitor C2 so that the capacitor $C_o$ is charged. At this time, the potential at the electrode $Y_j$ rises gradually depending upon time constant of the coil L3 and the capacitor $C_0$.

When the half cycle of resonance cycle by the coil L3 and the capacitor $C_o$ elapses, the switching device S11 is turned OFF while the switching device S13 is turned ON. As a result, the potential of the electrode $Y_j$ turns to an equal potential to the sustain voltage $V_{s1}$ containing the voltage correction value of the power supply B3. If, after a predetermined time elapses, the switching device S13 is turned OFF while the switching device S12 is turned ON, current flows to the capacitor C2 through a switching device S22, a switching device S15, a coil L4, a diode D4 and the switching device 12 based on electric charge accumulated in the capacitor $C_o$ so as to charge the capacitor C2.

At this time, the potential of the electrode $Y_j$ drops gradually depending upon time constant of the coil L4 and capacitor $C_o$. When the half cycle of resonance cycle by the coil L4 and the capacitor $C_o$ elapses (when the potential of the electrode $Y_j$ reaches 0V), the switching device S12 is turned OFF while the switching device S14 is turned ON.

By such operation, the Y electrode driver 4 applies sustain discharge pulse $IP_y$ of positive voltage to the electrode $Y_j$. In the sustain period, the sustain discharge pulse $IP_x$ and the sustain discharge pulse $IP_y$ are generated alternately and applied to the column electrode $X_1$–$X_n$ and the column electrodes $Y_1$–$Y_n$ alternately. As a result, the luminous discharge cell in which the wall charge remains repeats discharge light emission so as to sustain its light emission.

As shown in FIG. 1, the temperature detector 7 detects the temperature of the display panel, and the control portion 5 outputs a voltage correction value from that value. Because the drive voltage is adjusted through the D/A converter 6, automatic adjustment of the power voltage is enabled based on the panel temperature.

Further, because the control portion 5 is provided with the usage time computing circuit 9 for the display panel, it can output a voltage correction value corresponding to a passage time from the startup of the PDP unit, and can compute and output the voltage correction value by integrating PDP usage time and considering deterioration of brightness due to a change of the PDP with time passage. Because the analog voltage correction value is applied to the PDP drive circuit through the D/A converter 6, automatic adjustment of the drive voltage corresponding to the change of the PDP with time passage is enabled.

Further, by providing with the external control signal receiver 8 for receiving an external control signal from a remote controller, a personal computer or the like, the control portion 5 can output the voltage correction value corresponding to the external control signal so as to adjust the drive voltage. Consequently, the voltage can be adjusted by remote control or through the personal computer without removing a cover of the PDP main body.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2001-197990 filed on Jun. 29, 2001 including the specification, claims, drawings and summary is incorporated herein by reference in its entirety.

What is claimed is:

1. An apparatus, comprising:

a drive circuit that outputs a drive signal to a display panel; and a control circuit that generates correction data and outputs the correction data to the drive circuit, wherein the drive circuit adjusts the drive signal based on the correction data, wherein the drive circuit comprises an electrode drive circuit, wherein the electrode drive circuit comprises a sustain drive circuit, which has a power supply and which generates a sustain discharge pulse, and wherein the correction data is supplied to the power supply of the sustain drive circuit.

2. The apparatus as claimed in claim 1, wherein the drive signal comprises a drive voltage, and wherein the drive circuit adjusts the drive voltage based on the correction data.

3. The apparatus as claimed in claim 1, wherein the control circuit detects a temperature of the display panel, and wherein the control circuit generates the correction data based on the temperature.

4. The apparatus as claimed in claim 3, wherein the control circuit detects an amount of time that the display panel has been in use, and wherein the control circuit generates the correction data based on the amount of time.

5. The apparatus as claimed in claim 4, wherein the control circuit receives an external control signal from an external device, and wherein the control circuit generates the correction data based on the external control signal.

6. The apparatus as claimed in claim 1, wherein the control circuit detects an amount of time that the display panel has been in use, and wherein the control circuit generates the correction data based on the amount of time.

7. The apparatus as claimed in claim 1, wherein the control circuit receives an external control signal from an external device, and wherein the control circuit generates the correction data based on the external control signal.

8. An apparatus, comprising:

a drive circuit that outputs a drive signal to a display panel; and a control circuit that generates correction data and outputs the correction data to the drive circuit, wherein the drive circuit adjusts the drive signal based on the correction data, wherein the drive circuit comprises an electrode drive circuit, wherein the electrode drive circuit comprises a scan drive circuit, which has a power supply and which generates a scan pulse, and wherein the correction data is supplied to the power supply of the scan drive circuit.

9. The apparatus as claimed in claim 8, wherein the drive signal comprises a drive voltage, and wherein the drive circuit adjusts the drive voltage based on the correction data.

10. The apparatus as claimed in claim 8, wherein the control circuit detects a temperature of the display panel, and wherein the control circuit generates the correction data based on the temperature.

11. The apparatus as claimed in claim 10, wherein the control circuit detects an amount of time that the display panel has been in use, and wherein the control circuit generates the correction data based on the amount of time.

12. The apparatus as claimed in claim 11, wherein the control circuit receives an external control signal from an external device, and wherein the control circuit generates the correction data based on the external control signal.

13. The apparatus as claimed in claim 8, wherein the control circuit detects an amount of time that the display panel has been in use, and wherein the control circuit generates the correction data based on the amount of time.

14. The apparatus as claimed in claim 8, wherein the control circuit receives an external control signal from an external device, and wherein the control circuit generates the correction data based on the external control signal.

15. An apparatus, comprising:

a drive circuit that outputs a drive signal to a display panel; and a control circuit that generates correction data and outputs the correction data to the drive circuit, wherein the drive circuit adjusts the drive signal based on the correction data, wherein the drive circuit comprises a first electrode drive circuit and a second electrode drive circuit, wherein the correction data is supplied to the first electrode drive circuit and the second electrode drive circuit, wherein the first electrode drive circuit comprises a first sustain drive circuit having a first power supply, wherein the second electrode drive circuit comprises a second sustain drive circuit having a second power supply and a scan drive circuit having a third power supply, and wherein the correction data is supplied to the first power supply, the second power supply, and the third power supply.

16. The apparatus as claimed in claim 15, wherein the drive signal comprises a drive voltage, and wherein the drive circuit adjusts the drive voltage based on the correction data.

17. The apparatus as claimed in claim 15, wherein the control circuit detects a temperature of the display panel, and wherein the control circuit generates the correction data based on the temperature.

18. The apparatus as claimed in claim 17, wherein the control circuit detects an amount of time that the display panel has been in use, and wherein the control circuit generates the correction data based on the amount of time.

19. The apparatus as claimed in claim 18, wherein the control circuit receives an external control signal from an external device, and wherein the control circuit generates the correction data based on the external control signal.

20. The apparatus as claimed in claim 15, wherein the control circuit detects an amount of time that the display panel has been in use, and wherein the control circuit generates the correction data based on the amount of time.

21. The apparatus as claimed in claim 15, wherein the control circuit receives an external control signal from an external device, and wherein the control circuit generates the correction data based on the external control signal.

* * * * *